US006169709B1

(12) United States Patent
Schafroth

(10) Patent No.: US 6,169,709 B1
(45) **Date of Patent: *Jan. 2, 2001**

(54) WATCH MOVEMENT

(76) Inventor: Konrad Schafroth, Gutenbergstrasse 44, CH-3011, Bern, Schweiz (CH)

( * ) Notice: Under 35 U.S.C. 154(b), the term of this patent shall be extended for 0 days.

This patent is subject to a terminal disclaimer.

(21) Appl. No.: 09/232,648

(22) Filed: Jan. 19, 1999

Related U.S. Application Data

(63) Continuation-in-part of application No. 09/029,455, filed as application No. PCT/EP96/02791 on Jun. 26, 1996, now Pat. No. 5,881,027.

(30) Foreign Application Priority Data

Sep. 7, 1995 (CH) ..... 2545/95

(51) Int. Cl.[7] ..... G04B 1/00

(52) U.S. Cl. ..... 368/203; 368/204; 368/140; 368/148

(58) Field of Search ..... 368/203–204, 368/140, 147–149, 151, 155, 66

(56) References Cited

U.S. PATENT DOCUMENTS 4,141,064 2/1979 Nagashima .
5,517,469 5/1996 Wiget .
5,699,322 12/1997 Born .
5,740,131 4/1998 Bernasconi .
5,751,666 5/1998 Farine et al. .
5,881,027 * 3/1999 Schafroth ..... 368/203

FOREIGN PATENT DOCUMENTS 597 636 4/1978 (CH) .
0 239 820 A1 10/1987 (EP) .

* cited by examiner

*Primary Examiner*—Bernard Roskoski
(74) *Attorney, Agent, or Firm*—Birch, Stewart, Kolasch & Birch, LLP

(57) ABSTRACT

A timepiece movement proposed has a spring which drives, via gearing, a time display and a generator (1) supplying an a.c. voltage. The generator (1) powers, via a voltage-transformer circuit (2), a first capacitative component (10). The first capacitative component (10) powers an electronic reference circuit (3, 4, 5) with a stable oscillator (3, 4) and an electronic control circuit (6, 7, 8, 9). The first capacitative component (10) is charged immediately after the movement is started for the first time by one or more passive components. The one or more passive components are replaced, or supplemented in parallel, by one or more active units as soon as the voltage of the first capacitative component (10) is sufficient to operate the one or more active units, the one or more active units having a lower electrical resistance in the pass direction then the one or more passive components.

40 Claims, 4 Drawing Sheets

WATCH MOVEMENT

This application is a continuation-in-part of U.S. application Ser. No. 09/029,455, which was filed as a PCT application on Jun. 26, 1996 now U.S. Pat. No. 5,881,027, PCT application number PCT/EP96/02791, and which has a Section 371 date of Feb. 24, 1998 and a Section 102 (e) date of Feb. 24, 1998.

This invention relates to a watch movement according to the preamble of patent claim 1.

A watch movement is known from CH-597636, whose spring drives a time indicator and alternating-voltage-producing generator by means of gear train. The generator supplies voltage to a voltage transformer circuit, the voltage transformer circuit supplies voltage to a capacitative component, and the capacitative component supplies voltage to both an electronic reference circuit with a stable oscillator and an electronic control circuit. The electronic control circuit comprises a comparator-logic circuit and an energy dissipation circuit connected to the output of the comparator-logic circuit and whose power consumption is controllable by means of the comparator-logic circuit. One input of the comparator-logic circuit is connected to the electronic reference circuit and another input of the comparator-logic is connected with the generator via a comparator step and an anticoincidence circuit. The comparator-logic circuit is designed such that it compares a clock signal from the electronic reference circuit with a clock signal from the generator, and, depending on the result of this comparison, the comparator-logic circuit controls the magnitude of the power consumption of the electronic control circuit by means of the magnitude to the power consumption of the energy dissipation circuit. In this manner, the comparator circuit also controls the movement of the generator and thereby the movement of the time indicator by control of the power consumption of the control circuit.

The power consumption of the energy dissipation circuit in the watch movement known from CH-597636 is, however, only controllable in two steps by means of the comparator-logic circuit according to CH-597636. The power consumption of the energy dissipation circuit according to CH-597636 is, namely, either maximum or zero. This means that the generator can only either be braked with a maximum strength or not at all. Significant control oscillations in the movement control of the watch movement result thereby. In this manner, relatively bad energy efficiency of the watch movement is obtained.

Other electronic circuits are known from patent documents EP 0239820 and EP 679968 for controlling the speed of a micro-generator in which a monitoring circuit continuously monitors an angle position of a rotor and brakes it as soon as the angle position is leading.

The voltage transformer circuit according to CH-597636 is a rectifier. One typically uses diodes as rectifiers in watch technology, such as is known, for example, from the publications GB-A-2,158,274, EP-A-0,326,312, U.S. Pat. No. 4,653,931, EP-A-0,467,667, EP-A-0,326,313, EP-A-0,309,164, and EP-A-0,241,219. Diodes are passive components. The use of diodes as rectifiers during the total running time a watch movement impairs the energy efficiency of the watch movement because of the threshold voltage of the diode.

In a watch movement whose spring drives a time indicator and a generator by means of a gear train, the problem arises that only limited energy can be stored in the spring. The more power is needed for driving the watch movement, the shorter is the movement reserve of the watch movement. The necessary drive power is a combination of the mechanical drive power for the watch movement, frictional power, and the electrical power of the generator. The electrical power output of the generator is determined by the power consumption of an energy-using electronic circuit connected to the generator. It is further noted that the frictional power of the generator has a direct relationship with the voltage induced by the generator. As a rough estimate, the mass of the rotor of a generator must be greater the greater the induced voltage is to be. However, the frictional power and the mass moment of inertia of the rotor also increase with the-mass of the rotor. A relatively high mass moment of inertia of the rotor is, however, disadvantageous compared with a relatively small mass moment of inertia. If the rotor is, for example, stopped by an impact, it would start again more slowly with a relatively large mass moment of inertia compared with a relatively small mass moment of inertia. If the rotor has a relatively large mass moment of inertia it takes longer for it to once again achieve its nominal speed. There is thereby a danger during the starting phase of the rotor that the capacitive component will be discharged below a voltage level necessary to drive the watch electronics, this danger is naturally greater than with a rotor with a relatively small mass moment of inertia which accelerates more quickly so that the nominal speed is achieved more quickly.

Large electrical and mechanical energy losses necessarily lead, however, to a smaller movement reserve, or to the production to a watch movement with a larger spring, whereby the watch movement in its entirety has a greater volume.

It is an object of the present invention, to provide a watch movement whose spring drives a time indicator and a alternating-voltage-supplying generator by means of a gear train, which mechanism can be driven in a particularly energy-efficient manner.

This object is solved, according to the present invention, by a watch movement with the characteristics of patent claim 1.

The particularly good energy efficiency of the watch movement of the present invention according to claim 1 is achieved in which at least one passive component is at least intermittently replaced with an active component with a smaller electrical resistance in the conducting direction. In this fashion, the voltage losses are decreased and the efficiency thereby increased.

This object is also achieved by a watch movement with the features of patent claim 2.

With the watch movement of the present invention according to claim 2, the power consumption of the electronic control circuit is controllable in more stages than with the watch movement according to CH-597,636. By these means, the control oscillations and energy losses related to the control oscillations can be decreased.

The object is further solved by a watch movement according to the invention with the features of patent claim 3. With the watch movement of the present invention according to patent claim 3, the power consumption of the electronic control circuit is practically continuously controllable in a predetermined range of values. A distinct decrease in control oscillations and related distinct improvement of energy efficiency of the watch movement is thereby achieved in comparison with the watch movement according to CH-597,636.

Advantageous embodiments of the watch movement of the present invention according to claim 1 are the subject of patent claims 4 through 6, 8, 9, and 11 through 39. Advantageous embodiments of the watch movement of the present invention according to patent claims 2 and 3 are the subject of patent claims 7, 8, and 10 through 39.

The embodiments according to patent claims 5 to 7 combine the advantages of the watch movement of the present invention according to patent claim 1 and the watch movement of the present invention according to patent claim 2, or as the case may be, the watch movement of the present invention according to claim 1 and the watch movement of the present invention according to patent claim 31 respectively.

According to the embodiment of patent claim 8, the passive component is a diode and the accompanying active component is a switch controlled by a comparator. Voltage losses over the switch are at least about an order of magnitude smaller than voltage losses over a diode.

In the embodiments according to patent claims 12, 26, and 27 transistor structures are used in a double function as diodes and transistors. This is a particularly advantageous circuit technology and saves space.

The indicator for movement reserve in the embodiment according to patent claim 28 is particularly user friendly.

The circuit construction according to patent claims 32 and 33 as an IC is particularly advantageous in circuit technology and fabrication technology and is also space saving.

Embodiments of the invention are explained as follows by means by the drawings.

Figure 1:
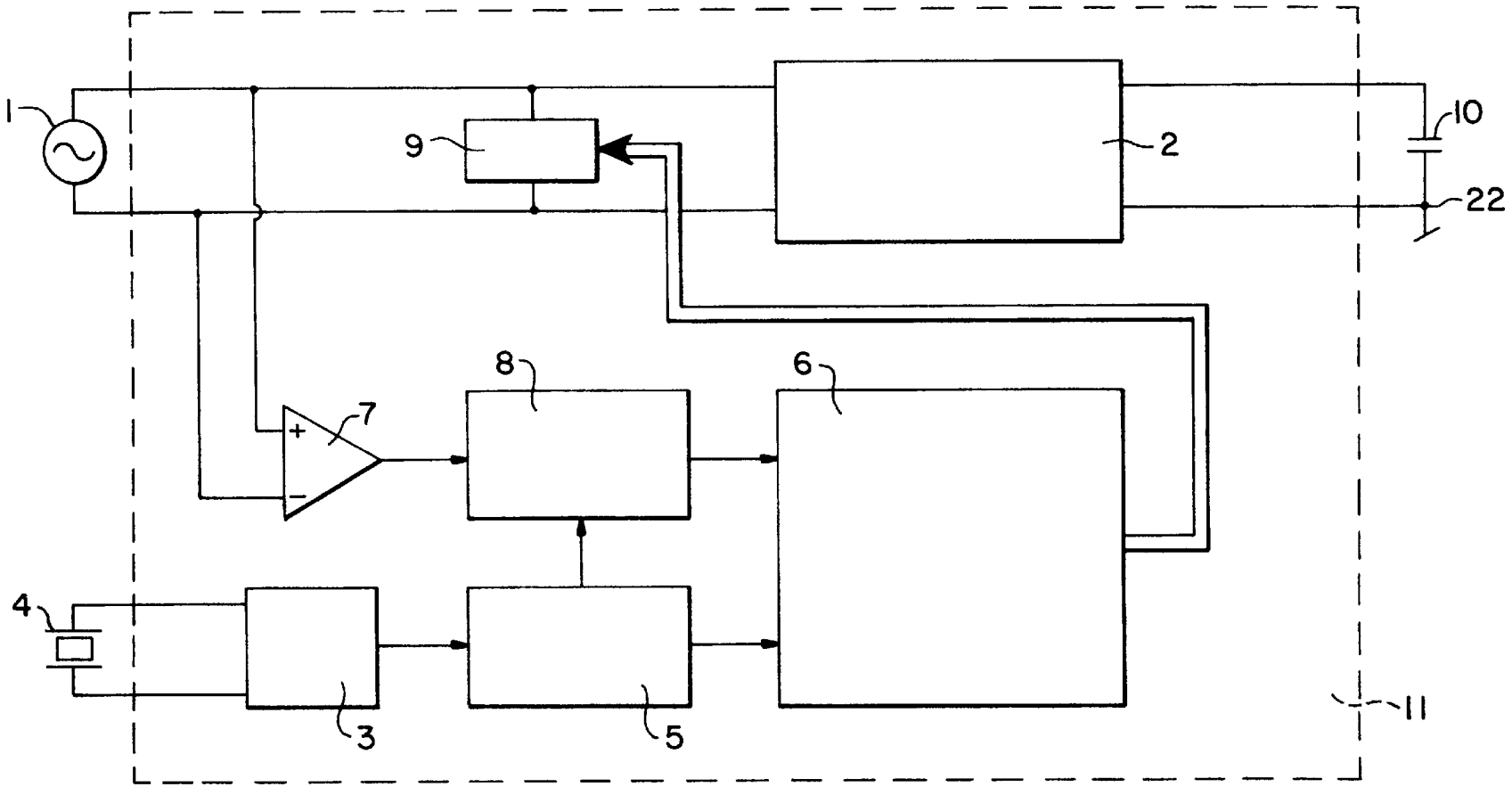
FIG. 1 is a block diagram of an electronic portion of the watch movement according to the present invention.

In FIG. 1, an electronic portion of a watch movement according to the present invention is shown in block diagram. An alternating-voltage-supplying generator (1) is connected with a spring (not shown) by means of a gear train (also not shown). The gear train drives the generator (1) and a time indicator (not shown). The nominal frequency of the alternating voltage of the generator (1) is preferably $2^n$ Hz, where n can be a natural number different from zero. The mechanical portion of the watch movement according to the invention is state of the art. Reference in this respect is made to CH-597,636.

Generator (1) energizes a voltage transformer circuit (2). The voltage transformer circuit (2) energizes a first capacitative component (10). The first capacitative component (10) energizes an electronic reference circuit (3, 4, 5) with a stable oscillator (3, 4) and an electronic control circuit (6, 7, 8, 9). The stable oscillator (3, 4) comprises a quartz resonator (4) whose oscillations define a reference frequency. The voltage transformer circuit (2), the electronic control circuit (6, 7, 8, 9), and the electronic reference circuit (3, 5), with the exception of the quartz resonator (4), and with the exception of all capacitative components present in the above circuit, are put together as IC 11. In another embodiment, even the capacitative components are integrated into IC 11.

The electronic control circuit (6, 7, 8, 9) comprises a comparator-logic circuit (6). One input of the comparator-logic circuit (6) is connected to the electronic reference circuit (3, 4, 5), and another input is connected with the generator (1) over comparator stage (7), detecting a crossover of the alternating-voltage, and an anticoincidence circuit (8). The anticoincidence circuit (8) is substantially a buffer storage which prevents a simultaneous input of impulses to both inputs of the compartator-logic circuit (6). In addition, the electronic control circuit (6, 7, 8, 9) comprises an energy dissipation circuit (9) connected with the output of the comparator-logic circuit (6) and controlled in its power consumption by the comparator-logic circuit (6).

The energy dissipation circuit (9) is made up of a plurality of equal ohmic resistors. The size of one ohmic resistor is small when compared with the size of the resistance that results when all ohmic resistors present are switched in series. The comparator-logic circuit (6) controls the power consumption of the energy dissipation circuit (9), in that it changes the number of ohmic resistors switched in the current path. In this manner, the power consumption of the electronic control circuit (6, 7, 8, 9) i s controllable in a substantially continuous manner in a predetermined range of values by the number of resistors.

It is also possible to build the energy dissipation circuit (9) as a controllable current source.

The comparator-logic circuit (6) compares a clock signal coming from the electronic reference circuit (3, 4, 5) with a clock signal coming from the generator (1). Dependent on the result of this comparison, the comparator-logic circuit (6) controls the magnitude of the power consumption of the electronic control circuit (6, 7, 8, 9) by means of the magnitude of the current consumption of the energy dissipation circuit (9). In this manner, by control of the control circuit power consumption, the operation of the generator (1) and thereby the operation of the time indicator are controlled. The control is designed so that the operation of the time indicator is synchronized in the desired manner with the reference frequency delivered by the quartz resonator (4).

The comparator-logic circuit (6) has a counter whose count reading corresponds to a speed or cycle difference between the generator (1) and the electronic reference circuit (3, 4, 5). The power consumption of the actual dissipation circuit (9) is controlled depended on the count reading of the counter. Depending on the state of the counter, the energy dissipation circuit (9) dissipates more or less energy and thereby loads the generator (1) more or less. Each count reading is assigned a predetermined effective resistor combination in the energy dissipation circuit (9). This means that the comparator-logic circuit (6) can, dependent on the count reading, switch the ohmic resistors in the energy dissipation circuit (9) singly, or in various combinations, into the active current path, or out of the active current path. This also takes into account the case in which none of the before-mentioned ohmic resistors are switched into the active current path at one or more count readings.

The control is, however, limited in that, when a particular count reading is achieved, the counting of generator impulses is interrupted. This is particularly necessary in order to effect a problem-free start of all electronic components of the watch movement and to provide for the case in which the spring is wound up again after a complete stop of the watch movement. A similar effect can be achieved if the comparator-logic circuit (6) and the energy dissipation circuit (9) are matched in such a fashion that, the power consumption of the energy dissipation circuit (9) is held to a minimum for a predetermined range of count reading (for example, 0 to 16), and the power consumption thereafter changes in a linearly proportional manner to the count reading when the predetermined range of count reading is exceeded. For the proposed example, this would mean that for a count of over 16, the power consumption of the energy dissipation circuit 9 would increase in a linearly proportional manner with increasing count reading and decrease in a linearly proportional manner with decreasing count reading. The minimizing of the power consumption of the energy dissipation circuit (9) in the afore-mentioned range of count reading has the result that a rotor of the generator (1) can thereafter be accelerated without hindrance if, for example, it were to have been stopped by an impact. Such—to the extent possible—unhindered and quick acceleration to the nominal speed is desirable because of the reason discussed above in terminal with the explanation of the mass moment of inertia of the rotor.

In order to further stabilize the control, the counting of impulses can be interrupted by a particular minimum reading of the counter.

The watch movement further comprises an assembly (not shown) for indicating the movement reserve dependent on the counter reading. The indication of movement reserve is achieved by means of an LCD.

The electronic reference circuit (3, 4, 5) comprises a frequency splitter circuit (5) connected between the stable oscillator (3, 4) and the terminal to the electronic control circuit (6, 7, 8, 9). This frequency splitter circuit (5) splits the reference frequency delivered from the quartz oscillator (4) in a defined manner in order to enable a more simple synchronization of the time indication.

Figure 2:
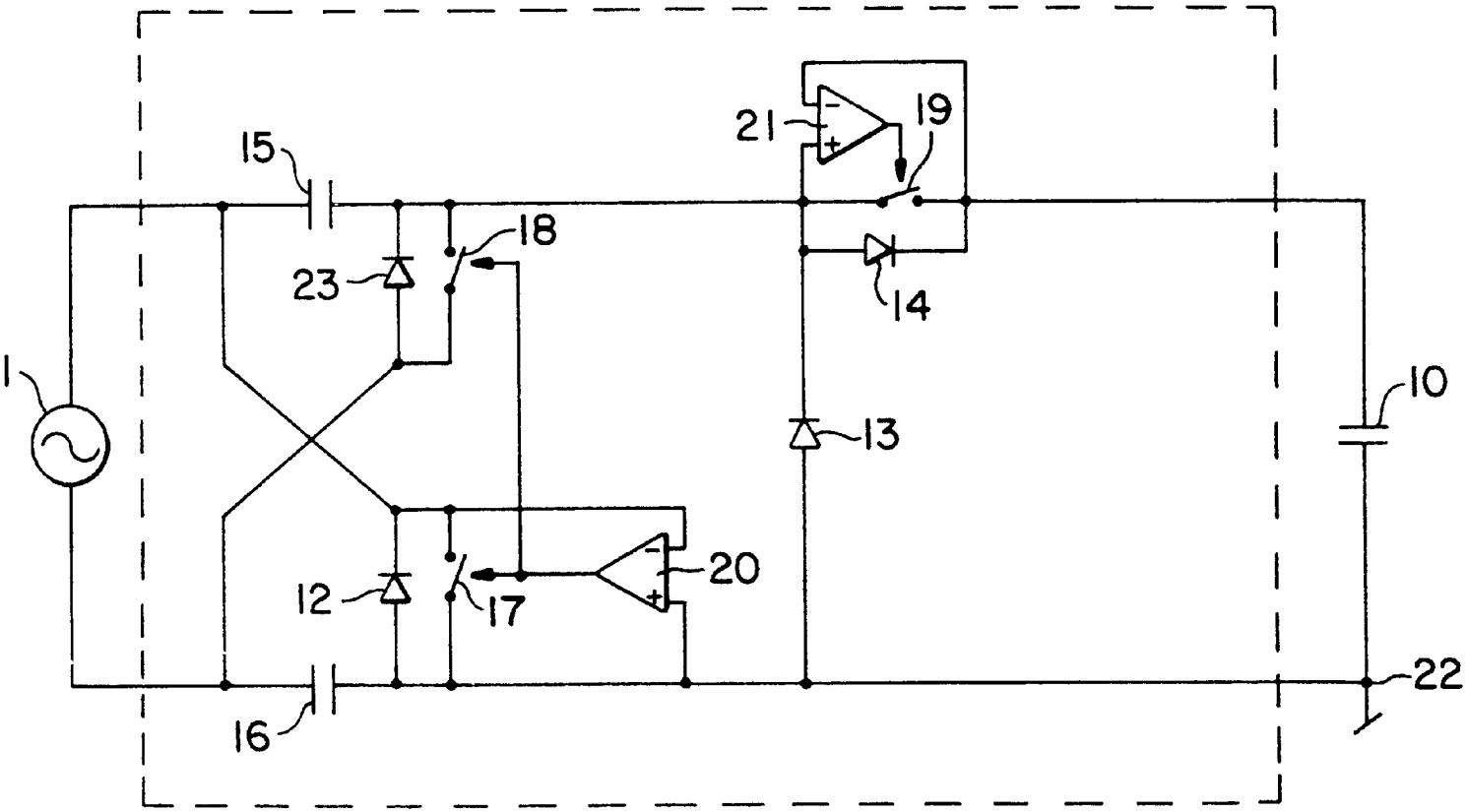
FIG. 2 is a schematic drawing of the voltage transformer circuit with a first embodiment of a voltage tripler circuit.
Figure 3:
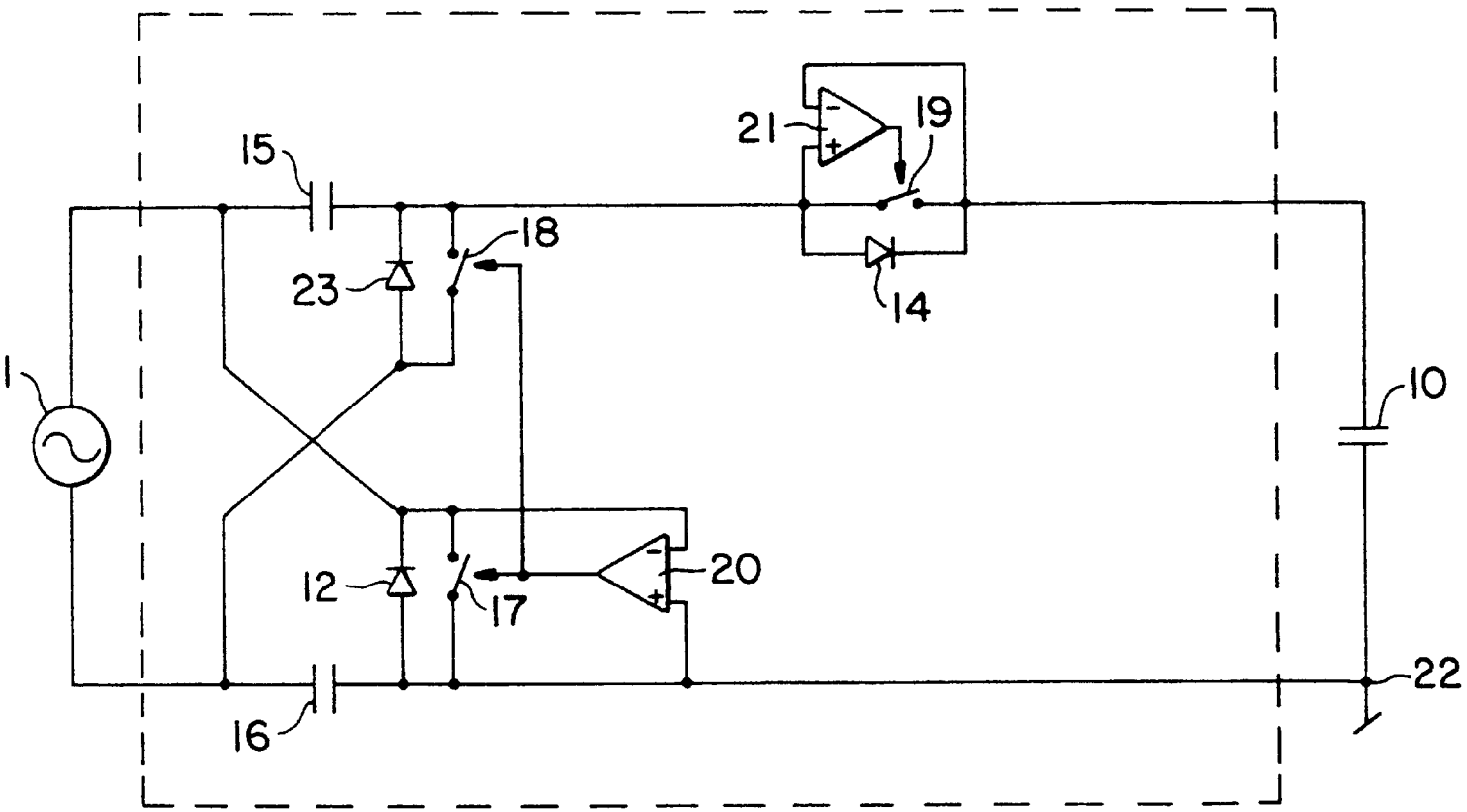
FIG. 3 is a schematic drawing of a voltage transformer circuit with a second embodiment of the voltage tripler circuit.
Figure 4:
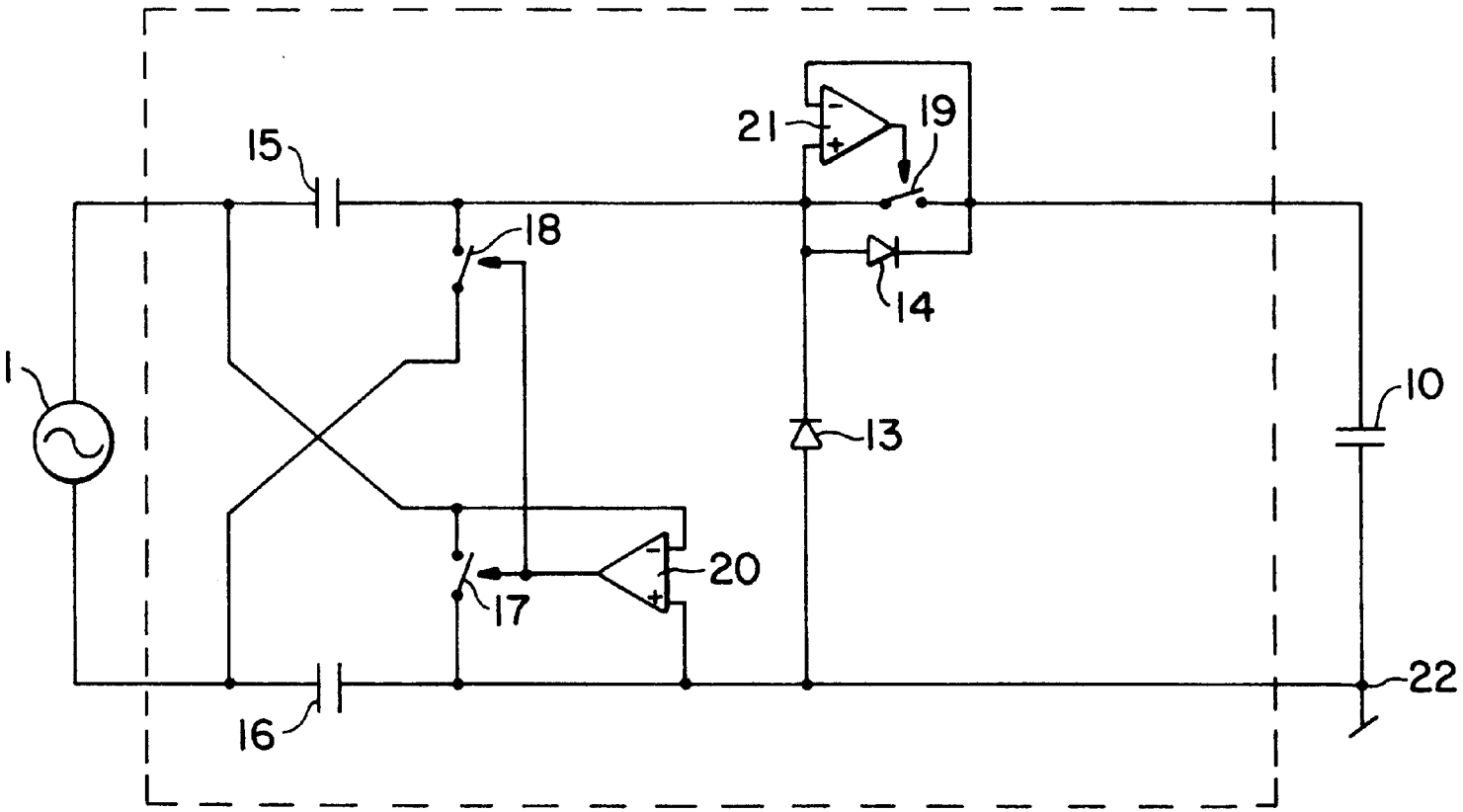
FIG. 4 is a schematic diagram of a voltage transformer circuit with a third embodiment of the voltage tripler circuit.

As can be seen from FIGS. 2 to 4, the voltage transformer circuit (2) carries out the functions of both a rectifier and a voltage tripler.

The first diode (14) is connected in series with the generator (1) and a first capacitative component (10). A first switch (19) is parallel to the first diode (14), but in series with the generator (1) and in series with the first capacitative component (10). The first switch (19) is actively controlled by a first comparator (21).

The voltage transformer circuit further comprises a voltage tripler circuit (12, 13, 15, 16, 17, 18, 20, 23) which is coupled on its input side to the generator (1) and coupled on its load side to the first capacitative component (10) and the parallel circuit of the first diode (14) and the first switch (19). A load-side terminal of the voltage tripler circuit (12, 13, 15, 16, 17, 18, 20, 23) runs together with the terminal of the first capacitive component (10) opposite the first diode (14) in a grounding knot (22).

The first comparator (21) compares the electrical potential of the terminal of the first capacitative component (10) that does not lie on the ground potential, with the electrical potential of the load-side terminal of the voltage tripler circuit (12, 13, 15, 16, 17, 18, 20, 23) that does not lie on the ground potential. The first switch (19) is only then closed by the first comparator (21) when the voltage of the first capacitative component (10) suffices to operate the first comparator (21) and the electrical potential at the ground free load terminal of the voltage tripler circuit (12, 13, 15, 16, 17, 18, 20, 23) is high enough for further charging of the first capacitive component (10).

The first switch (19) is a first field effect transistor and is connected so that in its closed state a portion of its structure acts as a first diode (14).

The spring, the gear train, the generator (1), the voltage transformer circuit (2), and the electronic control circuit (6, 7, 8, 9) are designed so that the generator (1) operates at a speed which is greater than the nominal speed of the generator (1) during the period from start of the watch movement until the point of the charging of the first capacitive component (10) to a predetermined value. In this manner, at first, the charging of the first capacitative component (10) is achieved by first diode (14).

The voltage value of the first capacitative component (10) sufficient to operate the first comparator and to operate a second comparator (20) disposed in the voltage tripler circuit (12, 13, 15, 16, 17, 18, 20, 23) (explained more fully below) is 0.6 V in this embodiment. The voltage drop of the first diode (14) is 400 mV. As soon as the first capacitative component is charged to at least 0.8 V, problem-free functioning of the electronic reference circuit (3, 4, 5), and the electronic circuit (6, 7, 8) is made possible. The first comparator (21) closes the first switch (19), that is, it opens the first field-effect transistor, as soon as the voltage delivered by the voltage tripler (12, 13, 15, 16, 17, 18, 20, 23) is higher than the voltage of the first capacitative component (10). The voltage drop over the channel of the first field-effect transistor, however, is only 10 mV. The voltage loss is substantially reduced. As soon as the voltage from the voltage tripler circuit (12, 13, 15, 16, 17, 18, 20, 23) sinks below the voltage of the first capacitive component (10), the first comparator (21) closes the first field-effect transistor. If the voltage from the voltage tripler (12, 13, 15, 16, 17, 18, 20, 23) once again climbs to a sufficiently high value, the first comparator (21) once again opens the first field-effect transistor, and so on. The charging of the first capacitive component (10) takes place only in the start phase of the watch movement by means of the first diode (14) with a large voltage loss. As movement proceeds, the first capacitive component (10) is only charged over the channel of the first field-effect transistor, which is substantially more energetically advantageous than charging over the first diode (14). In this manner, the energy reserve of the watch movement is used in a more economical manner and the movement reserve is increased.

It is not possible according to the present state of the art to build a micro-generator that has an induced voltage of more than 1.6V. This means that the voltage transformer circuit (2) must perform a voltage multiplying function in addition to its rectifier function. The already-mentioned voltage multiplier circuit (12, 13, 15, 16, 17, 18, 20, 23), serves this voltage multiplier function. In the present embodiment, the voltage multiplier circuit (12, 13, 14, 15, 16, 17, 18, 20, 23), is a voltage tripler circuit. Three embodiments of the voltage tripler circuit are shown in FIGS. 2 through 4.

In such a voltage multiplier circuit, the already-mentioned problem of voltage drop over the necessary diodes is always present. This problem is solved in the embodiments of the voltage multiplier circuit shown in FIGS. 2 through 4 in a similar manner to the problem of voltage drop over first diode (14). Second and third capacitative components (15, 16) are connected in series with generator (1), whereby generator (1) is positioned between the second capacitive component (15) and the third capacitive component (16). A first embodiment of the voltage tripler circuit (see FIG. 2) further comprises a parallel circuit of a second diode (12) and a second switch (17), along with a parallel circuit of a third diode (23) and a third switch (18). The parallel circuit of the second diode (12) and the second switch (17) is in series between the terminal of the second capacitive component (15) on the generator side and the terminal of the third capacitive component (16) on the load side. The parallel circuit of the third diode (23) and the third switch (18) is in series between the generator-side terminal of the third capacitive component (16) and the load-side terminal of the second capacitive component (15). The above briefly-mentioned second comparator (20) controls the second as well as the third switches (17, 18). The first embodiment of the voltage tripler circuit further comprises a fourth diode (13) in series between load-side terminals of the second and third capacitive components (15, 16).

The second, third, and fourth diodes (12, 23, 13) are arranged in the same conducting direction, and the first diode (14) is connected in an opposite conducting direction. The second comparator (20) compares the electrical potential of the terminal to generator (1) connected with the second capacitative component (15), with the electrical potential of the load-side terminal of the third capacitative component (16). The second and/or the third switches (17) and (18) are only closed by means of the second comparator (20) when the voltage of the first capacitive component (10) is sufficient to run the second comparator (20) and the electrical potential provided by the generator (1) is high enough to charge the second or third capacitive components (15, 16).

The second switch (17) is a second field-effect transistor, and the third switch (18) is a third field-effect transistor. The second field-effect transistor is connected so that in its closed state a portion of its structure works as a second diode (12). The third field-effect transistor is switched so that, in its closed state, a portion of its structure works as a third diode (23).

The second field-effect transistor and the third field-effect transistors are closed after a start of the watch movement. Charging of the second capacitative component (15) and the third capacitative component (16) is achieved by means of the second, third, and fourth diodes (12, 23, 13). The second comparator (20) opens the second field-effect transistor and the third field-effect transistor as soon as the voltage of the first capacitive component (10) reaches a minimum value of 0.8 V and the voltage delivered by generator (1) is higher than the voltage of the third capacitative component (16). Thereafter, charging of the second and third capacitive components (15, 16) is now achieved by means of the second field-effect transistor and the third field-effect transistor. Decrease of the voltage losses is the same as the above-described decrease of the voltage loss in the transition from the first diode to the first field-effect transistor. In an analogous manner, opening and closing of the second and third field-effect transistors is achieved by means of the second comparator (20). If the voltage delivered from generator (1) falls below the voltage of the third capacitative component (16), the second comparator (20) closes the second and third field-effect transistors. If the voltage delivered by the generator (1) climbs above the voltage of the third capacitive component (16), the second and third field-effect transistors are opened, that is, the second and third switches (17, 18) are closed. Compared with a pure use of diodes, an economical utilization of the energy reserve of the watch movement is thus also achieved in the voltage tripler circuit, whereby the movement reserve is increased.

A second embodiment of the voltage tripler is shown in FIG. 3, in which, in contrast to the first embodiment of the voltage tripler circuit, the circuit branch containing the fourth diode (13) is missing. Because the fourth diode (13) is not absolutely necessary for the functioning of the voltage tripler circuit, the second embodiment of the voltage tripler circuit also allows reliable functioning of the voltage transformer circuit (2). Of course, the respective diodes must always be fit to the actual circuit environment. The same also holds true for the third embodiment of the of the voltage tripler circuit shown in FIG. 4, which has only the circuit branch with fourth diode (13), but does not have the circuit branches with second diode (12) and third diode (23). In place of the parallel circuit of the second diode (12) and the second switch (17), or, as the case may be, the parallel circuit of the third diode (23) and the third switch (18) present in the first embodiment of the voltage tripler circuit, the fourth embodiment of the voltage tripler circuit has only the second switch (17) alone, or, as the case may be, the third switch (18) alone.

It is also conceivable that a voltage doubler circuit can be used in place of the described voltage tripler circuit. In this case, it must be ensured through selection of corresponding electronic components that the voltage transformer circuit (2) functions from a minimal peak voltage of the generator of from 0.5 V.

It is also possible to provide a controllable voltage multiplier circuit in place of a voltage multiplier circuit which increases the output voltage of generator (1) by a fixed value.

The voltage transformer circuit (2) and the electronic control circuit (6, 7, 8, 9) are adjusted so that the power consumption of the energy dissipation circuit (9) takes on a minimal value while any one of the capacitative components (10, 15, 16) is charged.

This is realized by using the output signal of the comparator (7), which detects zero crossings of the alternating voltage of the generator (1), to reset a counter in the comparator-logic circuit (6) to "0" and then enable it, each time that the alternating voltage of the generator (1) changes polarity. This counter receives a clock signal from the frequency splitter, or divider, (5). Upon achieving a first predetermined count condition, the power consumption of the energy dissipation circuit (9) is set to a minimal value. Upon achieving a second predetermined count condition, the energy dissipation circuit (9) is released, or enabled, and the generator can, depending on a required regulation, be thereby braked. Upon the next polarity change of the generator voltage, the counter is reset to 0 and enabled. The firs t predetermined count condition and the second predetermined count condition are chosen such that, with a desired rotation speed of the generator (1), the time period during which the energy dissipation circuit (9) assumes a minimal value, approximately corresponds to a time period during which the capacitors are charged. Thus it is guaranteed that the capacitors are charged to the highest possible value, independently of whether the generator has been greatly braked or not to this point in time.

The above described voltage transformer circuit can, of course, be combined with any desired rotational-speed regulator for the microgenerator (1), such as is described in patent documents EP 0239820 and EP 679968, for example.

In addition, the voltage transformer circuit (2) and the electronic control circuit (6, 7, 8, 9) are so designed that the power consumption of the energy dissipation circuit (9) regularly takes on a minimal value for $5\times10^{-4}$ s in intervals of $3\times10^{-2}$ s in order to allow the comparators (20, 22) to achieve a potential comparison corresponding to their function. Namely, if the potential comparison were to take place during a generator load over the minimal load of the generator, than the comparators (20, 21) would achieve false results with respect to the charge possibilities of the capacitative components (10, 15, 16, ) because they would detect a voltage that could be avoided with respect to a generator voltage at minimal load.

What is claimed is:

1. Watch movement, whose spring drives a time indicator and an alternating-voltage-supplying generator (1), wherein:

the generator (1) supplies current to a voltage transformer circuit (2), the voltage transformer circuit (2) supplies current to a first capacitative component (10), the first capacitative component (10) supplies current to an electronic reference circuit (3, 4, 5) with a stable oscillator (3, 4) and an electronic control circuit (6, 7, 9), wherein the electronic control circuit (6, 7, 9) includes:

a comparator-logic circuit (6) having one input connected with the electronic reference circuit (3, 4, 5) and another input connected to the generator (1) by means of a comparator step (7), and an energy dissipation circuit (9) connected to an output of the comparator-logic circuit (6) and controllable by its power consumption by the comparator logic circuit (6), wherein the comparator-logic circuit (6) is designed so that:

it compares a clock signal coming from the electronic reference circuit (3, 4, 5) with a clock signal originating from the generator (1), the comparator logic circuit (6) controls the power consumption of the electronic control circuit (6, 7, 9) by means of the magnitude of the power consumption of the energy dissipation circuit (9), in a manner dependent on the result of the comparison of the clock signals, and, in this manner, the comparator-logic circuit (6) controls the movement of the generator (1) by control of the power consumption of the control circuit, and thereby also controls the operation of the time indicator;

characterized in that:

the first capacitative component (10) is charged at least directly after a first start of the watch movement by means of a passive component or components, and the passive component or components are replaced by an active unit or a plurality of active units, or are supplemented by an active unit or a plurality of active units in a parallel circuit branch, as soon as the voltage of the first capacitative component (10) suffices to operate the active unit or units, whereby the active unit or units have a smaller electrical resistance in the conducting direction than the passive component or components.

2. Watch movement, whose spring drives a time indicator and alternating voltage-supplying generator (1), wherein:

the generator (1) supplies current to a voltage transformer circuit (2), the voltage transformer circuit (2) supplies current to a first capacitative component (10), the first capacitative component (10) supplies current to an electronic reference circuit (3, 4, 5) with a stable oscillator (3, 4) and an electronic control circuit (6, 7, 9), wherein the electronic control circuit (6, 7, 9) includes:

a comparator-logic circuit (6) having one input connected with the electronic reference circuit (3, 4, 5) and another input connected to the generator (1) via a comparator step (7), and an energy dissipation circuit (9) connected to an output of the comparator-logic circuit (6) and controllable by its power consumption by the comparator logic circuit (6), wherein the comparator-logic circuit (6) is designed so that:

it compares a clock signal coming from the electronic reference circuit (3, 4, 5) with a clock signal originating from the generator (1), the comparator logic circuit (6) controls the power consumption of the electronic control circuit (6, 7, 9) by means of the magnitude of the power consumption of an energy dissipation circuit (9), in a manner dependent on the result of the comparison of clock signals, and wherein, in this manner, the comparator-logic circuit (6) regulates the movement of the generator (1) by control of the power consumption of the control circuit, and thereby also controls the movement of the time indicator;

characterized in that:

the power consumption of the electronic control circuit (6, 7, 9) is controllable in at least three stages.

3. Watch movement, whose spring drives a time indicator and an alternating-voltage-supplying generator (1), wherein:

the generator (1) supplies current to a voltage transformer circuit (2), the voltage transformer circuit (2) supplies current to a first capacitative component (10), the first capacitative component (10) supplies current to an electronic reference circuit (3, 4, 5) with a stable oscillator (3, 4) and an electronic control circuit (6, 7, 9), wherein the electronic control circuit (6, 7, 9) includes:

a comparator-logic circuit (6) having one input connected with the electronic reference circuit (3, 4, 5) and another input connected to the generator (1) by means of a comparator step (7), and an energy dissipation circuit (9) connected to an output of the comparator-logic circuit (6) and controllable in its power consumption by the comparatorlogic circuit (6), wherein the comparator-logic circuit (6) is designed so that:

it compares a clock signal coming from the electronic reference circuit (3, 4, 5) with a clock signal originating from the generator (1), the comparator logic circuit (6) controls the power consumption of the electronic control circuit (6, 7, 9) by means of the magnitude of the power consumption of an energy dissipation circuit (9), in a manner dependent on the result of the comparison of clock signals, and wherein, in this manner, the comparator-logic circuit (6) regulates the movement of the generator (1) by control of the power consumption of the control circuit, and thereby also controls the movement of the time indicator;

characterized in that:

wherein the power consumption of the electronic control circuit (6, 7, 9) is controllable substantially continuously in a predetermined range of values.

4. Watch movement according to claim 1, characterized in that the voltage transformer circuit (2) and the electronic control circuit (6, 7, 9) are matched so that the power consumption of the energy dissipation circuit (9) takes on a minimal value while at least one of the first, second or third capacitive components (10, 15, 16) is charged.

5. A watch movement according to claim 1, characterized in that the power consumption of the electronic control circuit (6, 7, 9) is controllable in at least three stages.

6. A watch movement according to claim 1, characterized in that the power consumption of the electronic control circuit (6, 7, 9) is substantially continuously controllable in a predetermined range of values.

7. A watch movement according to claim 2, characterized in that:

the first capacitative component (10) is charged by a passive component or components, at least directly after a first start of the watch movement, and the passive component or components are replaced or supplemented in a parallel circuit by an active unit or a plurality of active units, as soon as the voltage of the first capacitative component (10) suffices to operate the active unit or units, whereby the active unit or units have a smaller electrical resistance in the conducting direction than the passive component or components.

8. A watch movement according to claim 1, characterized in that:

the voltage transformer circuit (2) includes:

a first diode (14) in series with the generator (1) and the first capacitative component (10), a first switch (19) in parallel to the first diode (14), in series with the generator (1) and in series with the first capacitative component (10), a first comparator (21) controlling the first switch (19), and a voltage multiplying circuit (12, 13, 15, 16, 17, 18, 20, 23), connected on an input side to the generator (1) and connected on a load side to the first capacitative component (10) and connected to the parallel circuit of the first diode (14) and the first switch (19);

wherein the first comparator (21) compares the electrical potential of a terminal of the first capacitative component (10) not lying at the ground potential with the electrical potential of a load-side terminal of the voltage multiplier circuit (12, 13, 15, 16, 17, 18, 20, 23) not lying at the ground potential;

wherein the first switch (19) is only then closed by the first comparator (21) to thereby allow charging of the first capacitative component (10) by the first switch (19), if the voltage of the first capacitative component (10) is sufficient to operate the first comparator (21), and the electrical potential at the non-grounded load-side terminal of the voltage multiplier circuit (12, 13, 15, 16, 17, 18, 21, 23) is high enough for further charging of the first capacitative component (10).

9. A watch movement according to claim 1, characterized in that the spring, gear train, generator (1), the voltage transformer circuit (2) and the electronic control circuit (6, 7, 9) are so designed that the generator (1) operates at a rotational speed that is greater than the nominal rotational speed of the generator (1) during a time directly after a start of the watch movement until a point in time at which the charging of the first capacitative component (10) reaches a voltage plateau high enough to enable functioning of all electronic components of the watch movement.

10. Watch movement according to claim 3, characterized in that the spring, gear train, generator (1), voltage transformer circuit (2) and the electronic control circuit (6, 7, 9) are designed so that the generator (1) operates at a rotational speed directly after start of the watch movement which is greater than the nominal speed of the generator (1), in order to enable start of the electronic reference circuit (3, 4, 5) and the electronic control circuit (6, 7, 9).

11. A watch movement according to claim 8, characterized in that the first switch (19) is a first transistor.

12. A watch movement according to claim 11, characterized in that the first transistor is connected so that in the closed state, one portion of the first transistor functions as a first diode (14).

13. A watch movement according to claim 1, characterized in that the energy dissipation circuit (9) comprises one or more ohmic resistors.

14. A watch movement according to claim 1, characterized in that:

the comparator-logic circuit (6) comprises a counter having a count reading corresponding to a movement difference between the generator (1) and the electronic reference circuit (3, 4, 5), and the power consumption of the energy dissipation circuit (9) is controlled dependent on the count reading of the counter.

15. A watch movement according to claim 14, characterized in that:

the energy dissipation circuit (9) comprises one or more ohmic resistors, and each count reading of the counter corresponds to an associated predetermined effective resistance combination, including the resistance zero, of the energy dissipation circuit (9).

16. A watch movement according to claim 14, characterized by a switch assembly for interrupting an input of counts at a predetermined high counter reading.

17. A watch movement according to claim 8, characterized in that the voltage multiplier circuit (12, 13, 15, 16, 17, 18 20, 23) is a controllable voltage multiplier circuit.

18. A watch movement according to claim 8 characterized in that the voltage multiplier circuit (12, 13, 15, 16, 17, 18, 20, 23) substantially doubles the output voltage of the generator (1).

19. A watch movement according to claim 18, characterized in that the voltage transformer circuit (2) functions as of a minimal peak voltage of the generator of 0.5 V.

20. A watch movement according to claim 8, characterized in that the voltage multiplier circuit (12, 13, 15, 16, 17, 18, 20, 23) substantially triples the output voltage of the generator (1).

21. A watch movement according to claim 20, characterized in that the voltage transformer circuit (2) functions as of a minimal peak voltage of the generator of 0.3 V.

22. A watch movement according to claim 20, characterized in that the voltage multiplier circuit (12, 13, 15, 16, 17, 18, 20, 23) includes:

second and third capacitative components (15, 16), connected in series with the generator (1), whereby the generator (1) is positioned between the second capacitative component (15) and the third capacitative component(16), a parallel circuit of a second diode (12) and a second switch (17), whereby the parallel circuit of the second diode (12) and the second switch (17) are connected in series between the generator-side terminal of the second capacitative component (15) and the loadside terminal of the third capacitative element, a parallel circuit of a third diode (23) and a third switch (18), whereby the parallel circuit of the third diode (23) and the third switch (18) are connected in series between the generator-side terminal of the third capacitative component (16) and the load-side terminal of the second capacitative component (15), and a second comparator (20) controlling the second and third switches (17, 18), wherein:

the second and third diode (12, 23) are connected in the same conducting direction and the first diode (14) in an opposite conducting direction, the second comparator (20) compares the electrical potential at the terminal to the generator (1) connected with the second capacitative component (15), with the electrical potential at the load-side terminal of the third capacitative component (16), and the second and/or the third switch (17, 18) is only closed and thereby enabling a charging of the second or third capacitative component (15, 16) by the third or second switch (18, 17), respectively, if the voltage of the first capacitative component (10) suffices to operate the second comparator (20), and the electrical potential produced by the generator (1) is high enough to charge the second or third capacitative component (15, 16).

23. A watch movement according to claim 22, characterized in that the voltage multiplier circuit (12, 13, 15, 16, 17, 18, 20, 23) comprises a fourth diode (13) in series between the load-side terminals of the second and third capacitative components (15, 16), whereby the fourth diode (13) is arranged in a conducting direction opposite to that of the first diode (14).

24. A watch movement according to claim 20, characterized in that the voltage multiplier circuit (12, 13, 15, 16, 17, 18, 20, 23) comprises:

second and third capacitative components (15, 16), connected in series with the generator (1), whereby the generator (1) is disposed between the second capacitative component (15) and the third capacitative component (16), a second switch (17) connected in series between the generator-side terminal of the second capacitative component (15) and the load-side terminal of the third capacitative component (16), a third switch (18) connected in series between the generator-side terminal of the third capacitative component (16) and the load-side terminal of the second capacitative component (15), a second comparator (20) for controlling the second and third switches (17, 18), and a fourth diode (13) connected in series between the load-side terminals of the second and third capacitative components (15, 16), wherein:

the fourth diode (13) is connected in an opposite conduction direction to that of the first diode (14), the second comparator (20) compares an electrical potential at the terminal of the generator (1) connected to the second capacitative component (15), with an electrical potential at a load-side terminal of the third capacitative component (16), and the second and/or third switch (17, 18) is only closed by the second comparator (20) and thereby enables charging of the second or third capacitative element (15, 16) if the voltage of the first capacitative component (10) suffices to operate the second comparator (20), and the electrical potential available from the generator (1) is high enough to charge the second or third capacitative component (15, 16).

25. A watch movement according to claim 22, characterized in that the second switch (17) is a second transistor and the third switch (18) is a third transistor.

26. A watch movement according to claim 25, characterized in that the second transistor is connected so that, in the closed state, a portion of the structure of the second transistor functions as a second diode (12).

27. A watch movement according to claim 25, characterized in that the third transistor is connected so that, in the closed state, a portion of the structure of the third transistor functions as a third diode (23).

28. A watch movement according to claim 14, further comprising an assembly for indicating the movement reserve dependent on the count reading.

29. A watch movement according to claim 14, characterized in that the comparator-logic circuit 6 and the energy dissipation circuit 9 are meshed so that the power consumption of the energy dissipation circuit (9) is held to a minimum during a predetermined range of counts and changes in a linearly proportional manner after the predetermined count is exceeded.

30. A watch movement according to claim 28, characterized in that the indication of the movement reserve is achieved by an LCD.

31. A watch movement according to claim 1, characterized in that the stable oscillator (3, 4) comprises a quartz resonator (4).

32. A watch movement according to claim 31, characterized in that the voltage transformer circuit (2), the electronic control circuit (6, 7, 9) and the electronic reference circuit (3, 5), with the exception of the quartz resonator (4), are constructed as an IC.

33. A watch movement according to claim 31, characterized in that the voltage transformer circuit. (2), the electronic control circuit (6, 7, 9) and the electronic reference circuit (3, 5), with the exception of the quartz resonator (4), and with the exception of various capacitative components present in said circuits, are constructed as an IC.

34. A watch movement according to claim 22 characterized in that the voltage transformer circuit (2) and the electronic control circuit (6, 7, 9) are matched so that a power consumption of the energy dissipation circuit (9) assumes a minimal value while at least one of the first, second and third capacitive components (10, 15, 16) is charged.

35. A watch movement according to claim 1, characterized in that the voltage transformer circuit (2) and the electronic control circuit (6, 7, 9) are structured so that during a second defined time period following a first defined time period after a polarity change of the generator voltage, the power consumption of the energy dissipation circuit assumes a minimal value.

36. A watch movement according to claim 35 characterized in that the first defined time period is approximately 10 ms and the second defined time period assumes a minimum period of approximately 8 ms during energy input to the energy dissipation circuit (9).

37. A watch movement according to claim 35, characterized in that the defined time periods are set by a counter which receives a clock signal from a frequency splitter (5), wherein the counter is reset to 0 by the output signal of the comparator (7) and is then enabled each time the alternating voltage of the generator (1) changes its polarity, whereby upon achieving a first predetermined count the power consumption of the energy dissipation circuit (9) is set to a minimum value and then at the second predertermined count the energy dissipation circuit (9) is again enabled.

38. A watch movement according to claim 1, characterized in that a frequency splitter circuit (5) is connected in the electronic reference circuit (3, 4, 5) between the stable oscillator (3, 4) and the terminal to the electronic control circuit (6, 7, 9).

39. A watch movement according to claim 1, characterized in that the energy dissipation circuit (9) is a regulatable current source.

40. Watch movement, whose spring drives a time indicator and an alternating-voltage-supplying generator (1), wherein:

the generator (1) supplies current to a voltage transformer circuit (2), the voltage transformer circuit (2) supplies current to a first capacitative component (10), the first capacitative component (10) supplies current to an electronic circuit (3, 4, 5, 5,7,8,9) to regulate a rotation speed of the generator (1), wherein the first capacitive component (10) is charged via at least one passive component immediately after a first activation of the watch movement, and at least one active component is switched into the circuit when the charge of the at least one passive component is sufficient to drive the at least one active component, whereby the at least one active component provides a smaller resistance in a conducting direction.

* * * * *

UNITED STATES PATENT AND TRADEMARK OFFICE

CERTIFICATE OF CORRECTION

PATENT NO. : 6,169,709 B1
DATED : January 2, 2001
INVENTOR(S) : Konrad Schafroth It is certified that error appears in the above-identified patent and that said Letters Patent is hereby corrected as shown below:

Title page,
Item [63] Related U.S. Application Data, please replace

"Continuation-in-part of application No. 09/029,455, filed as application No. PCT/EP96/02791 on Jun. 26, 1996, now Pat. No. 5,881,027."

with

-- Continuation-in-part of application No. 09/029,455 filed February 24, 1998, now Pat. No. 5,881,027, which is the 371 application of PCT/EP96/02791, filed June 26, 1996. --

Signed and Sealed this

Twenty-ninth Day of January, 2002

*Attest:*

*Attesting Officer*

JAMES E. ROGAN
*Director of the United States Patent and Trademark Office*